US006270121B1

(12) United States Patent
Dolan et al.

(10) Patent No.: US 6,270,121 B1
(45) Date of Patent: Aug. 7, 2001

(54) BROCHURE WITH REMOVABLY ATTACHED PRODUCT INFORMATION SHEET

(75) Inventors: William J. Dolan, Gladston; Frank C. Wohlers, Blairstown, both of NJ (US)

(73) Assignee: Patch Industries, Inc., Boonton Township, NJ (US)

( * ) Notice: Subject to any disclaimer, the term of this patent is extended or adjusted under 35 U.S.C. 154(b) by 0 days.

(21) Appl. No.: 09/708,943

(22) Filed: Nov. 8, 2000

Related U.S. Application Data

(60) Provisional application No. 60/168,954, filed on Dec. 3, 1999.

(51) Int. Cl.[7] ..... B42D 15/00

(52) U.S. Cl. ..... 283/81; 283/56; 283/105

(58) Field of Search ..... 283/56, 79, 80, 283/81, 101, 105; 40/299; 428/43, 42.2, 42.3

(56) References Cited

U.S. PATENT DOCUMENTS 4,551,373 * 11/1985 Conlon ..... 283/81
5,290,616 * 3/1994 Cowan et al. ..... 283/81 X
6,057,019 * 5/2000 Barry ..... 283/81 X

* cited by examiner

*Primary Examiner*—Willmon Fridie, Jr.
(74) *Attorney, Agent, or Firm*—Anthony J. Casella; Gerald E. Hespos

(57) ABSTRACT

A brochure assembly is provided. The brochure assembly includes a primary brochure formed from a unitary sheet of a foldable material such as a high quality paper board material having a glossy finish and printed with selected textural and graphic indicia. The sheet of material that forms the primary brochure includes front and rear panels that are hingedly connected to one another along a fold line. The front and rear panels each include an inner face and an outer face. A product information patch is removably attached to one of the panels and preferably to the outer face of the rear panel. The product information patch includes a base label secured to the primary brochure, a folded product information sheet positioned centrally on the base label and an overlaminate secured over the folded product information sheet and the base label. The overlaminate includes perforation arrays on opposite respective sides of the folded product information sheet to facilitate separation of the product information sheet from the primary brochure.

12 Claims, 4 Drawing Sheets

BROCHURE WITH REMOVABLY ATTACHED PRODUCT INFORMATION SHEET

This application claims the benefit of U.S. Provisional Patent Appl. No. 60/168,954 filed Dec. 3, 1999.

BACKGROUND OF THE INVENTION

1. Field of the Invention

The subject invention relates to brochures, such as those used to promote pharmaceutical products. The brochure is provided with product information sheet removably adhered to a face of the brochure.

2. Description of the Related Art

Manufacturing companies, and particularly pharmaceutical companies, devote substantial amounts of time, effort and money to promote their products. Brochures are one common vehicle for promoting such products. A substantial amount of creative effort is invested in the design, layout and production of a brochure. A typical brochure will be printed in multiple colors on a glossy paper or paper board. The brochure will include text and graphics to summarize uses and attributes for the product in an effort to develop consumer interest. Pharmaceutical products, in particular, may include text and graphics to convince doctors and other people in the medical profession that a particular pharmaceutical product has attributes that should be considered favorably by the targeted purchaser.

Some manufacturers are obligated to provide very detailed information with certain of their products or with any advertisements for such products. This requirement is particularly common in the pharmaceutical industry. For example, pharmaceutical companies invariably package and promote their products with extensive product information to identify ingredients and intended uses. Such information might also include disclaimers to identify possible adverse effects and to identify certain classes of consumers who should not use the pharmaceutical products or who should be carefully monitored during use. Some such information is dictated by law. Other such information is dictated or suggested by product liability attorneys who represent the manufacturer.

The packaging in which the pharmaceutical product is sold typically is not large enough to encompass all of the required product information, disclaimers, warnings and recommended uses. As a result, many pharmaceutical products are sold with an extended content label or product information sheet that is attached to the container of the pharmaceutical product or inserted into the package for the product. In some situations the extended content label may be removably secured to the product or to the product packaging.

Extensive product information disclaimers, warnings and recommended uses also typically are required to be incorporated into brochures that are used to introduce or promote a pharmaceutical product. The extensive text and disclaimers required for such product information sheets will have a substantial adverse effect on the aesthetic appearance of the brochure that is carefully designed to promote the product. Accordingly, most manufacturers of pharmaceutical products will design the brochure to include a pocket in which the product information sheet is removably stored. The product information sheet in the pocket complies with legal or regulatory requirements and generally is accepted by the product liability law counselors for the pharmaceutical company. However, this prior art approach adds significantly to the cost of the brochure and can adversely affect the aesthetics. For example, the pocket typically requires an additional flap of the expensive colored glossy paper or paper board material, and hence can add as much as 50% to the raw material costs of the brochure. Furthermore, the pocket typically requires a careful gluing of the expensive paper or paper board material, and the gluing typically adds to the production costs. The production of the brochure with the pocket is only part of the additional cost. In particular, the product information sheet typically must be inserted manually into the pocket of the brochure. This manual insertion of the product information sheet into the prior art brochure requires a very substantial increase in labor costs.

One such prior art brochure is shown schematically in FIGS. 1–3 and is identified generally by the numeral 10. Prior art brochure 10 is formed from a blank of glossy paper board material 12 that is cut and scored to define the rear panel 14, a front panel 16 and an inside panel 18. The side glue flap 20 extends from the longitudinal side of the inside panel 18 opposite the front panel 16 and a bottom glue flap 22 extends from the bottom of the inside panel 18. The side glue flap 20 is adhered to the inner surface of the front panel 16 adjacent the foldable connection to the rear panel 14. The bottom glue flap 22 is adhered to the inner surface of the front panel 16 adjacent the bottom thereof. As a result, a pocket is defined in the brochure between the front panel 16 and the inside panel 18. The pocket is accessible along the open top between the front panel 16 and the inside panel 18. Indicia 23 in proximity to the open top may include an appropriate legend, such as "Prescribing Information".

The product information sheet is identified by the numeral 24 and is manually inserted into the open top and between the front panel 16 and the inside panel 18.

It will be appreciated that the inside panel 18 is provided only to create the pocket to receive the product information sheet 24. The material printed on the inside panel would otherwise be printable directly on the inner face of the front panel 16. It will further be appreciated that the requirement for the inside panel 18 adds approximately 50% to the raw material costs for the brochure 10. High quality glossy paper board used for such brochures is expensive. Furthermore, the careful gluing of the side glue flap 20 and the bottom glue flap 22 adds to manufacturing costs. Additionally, as noted above, the manual insertion of the product information sheet 24 adds to labor costs.

In view of the above, it is an object of the subject invention to provide a brochure that can provide extended product information with a minimum investment in raw materials for the brochure. It is a further object of the subject invention to minimize the expensive and careful gluing required to create a pocketed brochure. It is still another object of the invention to provide a brochure that can be produced with minimal required manual labor.

SUMMARY OF THE INVENTION

The subject invention is directed to a brochure assembly formed from a paper or paper board material. The brochure assembly may include a primary brochure that may be formed without a glue flap and without manufacturing process steps to adhere portions of the primary brochure into folded engagement with itself for defining an accessible pocket in the primary brochure. Thus, the primary brochure may include only a front panel and a rear panel formed from a unitary sheet of paper or paper board material and articulated to one another along a score line or fold line.

The brochure assembly further includes a product information sheet that is removably attached to the primary brochure. The product information sheet may first be printed, folded and then at least partly enclosed between a base label and an overlaminate. The base label and the overlaminate may be formed from paper or plastic materials. The base label and the overlaminate preferably are of approximately equal lengths and are longer than the folded insert by a selected distance. Thus, the printed and folded product information sheet can be positioned centrally between the top and bottom edges of the base label. Base label wings then extend from the folded product information sheet to the respective top and bottom edges of the base label. The overlaminate then can be disposed over and secured to the top panel of the folded product information sheet and to the base label wings, such that top and bottom edges of the overlaminate and the top and bottom edges of the base label are registered. Secured regions of the base label and the overlaminate may extend only along the parallel top and bottom edges. Side edges of the base label may extend slightly beyond the folded product information sheet. However, the side edges of the over laminate preferably register with the side edges of the folded product information sheet, without being secured to the base label.

The overlaminate preferably is formed with weakened regions disposed adjacent the respective top and bottom edges of the folded product information sheet. The weakened regions preferably are defined by a linear array of perforations. Folded product information sheets that have a greater thickness will require a further distance between the folded product information sheet and the weakened regions. More particularly, a perforation that is too close to a thick folded product information sheet could cause the perforation to rupture during handling.

The surface of the base label opposite the product information sheet is securely affixed to an appropriate location on the primary brochure. This affixation can be carried out automatically and at a high speed. The affixation of the base label to the primary brochure may be carried out with an appropriate adhesive combined with pressure and/or heat.

The product information sheet can be accessed merely by gripping the product information sheet and the over laminate near a side edge. A slight pulling force then separates the overlaminate at one or both weakened regions and enables the product information sheet to be removed easily and unfolded.

The subject invention also is directed to a method for forming a brochure assembly. The method comprises the step of providing a primary brochure that is appropriately printed and, if necessary, folded. The primary brochure may include a selected location for affixation of a product information sheet. The method further comprises printing a product information sheet. The printing of the product information sheet preferably is carried out on an ultra thin paper, and preferably a paper stock of 40# or less. A paper stock of 30# is preferred. The folding of the product information sheet preferably is carried out such that the front of the folded product information sheet has two closed ends.

The method proceeds by positioning the folded product information sheet between a base label and an overlaminate. More particularly the base label and the overlaminate may be fed from rolls, and the folded product information sheet may be positioned between the advancing rolls. The overlaminate then is secured to top and bottom edge regions of the base label and to the front panel of the product information sheet to define a product information patch. The surface of the base label opposite the product information sheet may have a layer of pressure activated adhesive and may be removably adhered to a carrier strip.

The product information patch then is fed on the carrier strip to the selected location on the primary brochure such that the surface of the base label opposite the folded product information sheet is positioned on the primary brochure. The product information patches then are secured in this selected location by the adhesive and pressure. The pressure may be achieved with compressed air.

The method step of providing an overlaminate may include providing an overlaminate with a pair of parallel side perforations spaced inwardly from the top and bottom edges of the overlaminate and outwardly from the location designated for the folded product information sheet.

DETAILED DESCRIPTION OF THE PREFERRED EMBODIMENTS

Figure 1:
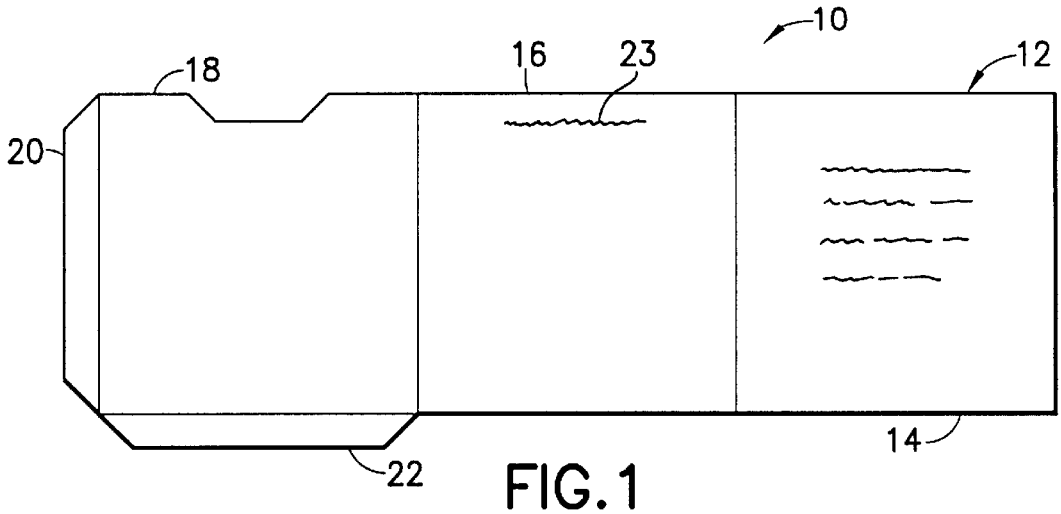
FIG.1 PRIOR ART
FIG. 1 is a plan view of a prior art blank for forming a prior art brochure with a pocket for receiving a product information sheet.

A brochure assembly in accordance with the subject invention is identified by the numeral 28 in FIGS. 4–8. The brochure assembly 28 includes a primary brochure 30 that is formed from a unitary sheet of paper or paper board material that preferably is a high quality paper board material having a glossy finish and printed in a plurality of colors. For simplicity, the figures do not depict any of the graphic or textural indicia that is likely to be imprinted on the primary brochure 30. The sheet material from which the brochure 30 is formed is illustrated as being substantially rectangular in FIGS. 4–9. However, other non-rectangular configurations can be provided.

The primary brochure 30 is formed to include a rectangular front panel 32 and a rectangular rear panel 34 that are articulated relative to one another along a fold line 36. The front panel 32 includes an inside face 38 and an outside face 40. The rear panel 34 similarly includes an inside face 42 and an outside face 44. The front and rear panels 32 and 34 can be articulated relative to one another about the fold line 36 such that the inner faces 38 and 42 of the front and rear panels 32 and 34 respectively lie in face-to-face engagement with one another and such that the outer faces 40 and 44 of the front and rear panels 32 and 34 respectively will face outwardly on the panel folded into the condition shown in FIGS. 6 and 7.

The brochure assembly 28 further includes a product information patch 45 removably adhered to the outer face 44 of the rear panel 34 of the primary brochure 30. More particularly, the product information patch 45 comprises a product information sheet 46 that is sandwiched between a base label 48 and an overlaminate 49.

The product information sheet 46 comprises a single sheet of ultra thin paper printed on a web press to provide appropriate and necessary information about the product that is being promoted by the brochure. The ultra thin paper of the product information sheet 46 is no greater than 40#, and preferably is about 30#. The size of the ultra thin paper of the product information sheet 46 can vary depending upon the size of the brochure assembly 28 and the amount of information that is required to be printed on the product information sheet 46. However, the size of the product information sheet also is limited by design criteria of the subject of the product information patch 45. More particularly, the product information sheet 46 preferably defines a maximum flat size of 24"×20". The product information sheet 46 then is folded. The maximum number of folds for the product information sheet 46 is 14 and the maximum number of panels/pages is 36/72. The folding is carried out to provide a folded product information sheet 46 with a maximum size of 7.25" by 9.5" and a minimum folded size of 1.375"×2.5". The folding also is carried out to provide two parallel closed ends defined by folds adjacent the panel of the folded product information sheet 46 that will define the front panel. In this context, the front panel is the side of the folded product information sheet 46 that will face away from the primary brochure 30.

The base label is formed from a plastic, paper or plastic coated paper sheet material that can be adhered to the outside face 44 of the rear panel 34 of the primary brochure. Additionally, the base label 48 is formed from a material that can be adhered to the overlaminate 49. A preferred material for the base label is a flexible transparent plastic about 2 mils thick. The base label 48 also may be printed on at least a portion of the surface of the base label 48 that will face away from the primary brochure 30.

The base label 48 includes top and bottom edges 52 and 54 which are spaced from one another by a distance that exceeds the distance between the parallel fold lines on the front panel of the folded product information sheet 46. Thus, the folded product information sheet can be positioned centrally between the top and bottom edges 52 and 54 of the base label 48, with base label wings 56 and 58 extending inwardly from the top and bottom edges 52 and 54 and the folded product information sheet 46. The wings 56 and 58 define a height "h" of at least 0.25", and preferably less than 0.562". The base label 48 also includes side edges 60 and 61 that define a width "W"

The overlaminate 50 preferably is formed from a transparent plastic sheet material that has adhesive applied to one surface. A preferred material for the overlaminate is a flexible transparent plastic sheet material about 1 mil thick. The adhesive on the overlaminate 50 is selected to ensure good adhesion to both the product information sheet 46 and the base label 48. The overlaminate 50 has top and bottom edges 62 and 64 that are spaced from one another by a distance substantially equal to the distance between the top and bottom edges 52 and 54 of the base label 48. The overlaminate 50 further includes a pair of parallel perforation arrays 66 and 68 that are spaced symmetrically inwardly from the top and bottom edges 62 and 64 of the overlaminate 50. However, the perforation arrays 66 and 68 are spaced from one another by a distance greater than the distance between the parallel fold lines on the top panel of the folded product information sheet 46. The overlaminate 50 also has side edges 70 and 72 that define a width "w" less than the width W of the base label 48 and approximately equal to the length of the fold lines on the front panel of the product information sheet 46.

The product information patch 45 is formed by placing the folded product information sheet 46 on the upper non-adhesive surface of the base label 48 at a position centrally between the top and bottom edges 52 and 54 and centrally between the side edges 60 and 61 of the base label 48. Additionally, the parallel fold lines of the front panel of product information sheet 46 are parallel to the top and bottom edges 52 and 54 of the base label 48. Additionally, the parallel fold lines of the front panel of product information sheet 46 are parallel to the top and bottom edges 52 and 54 of the base label 48. The overlaminate 50 then is applied over and secured to the properly positioned folded product information sheet 46 and base label 48. This application of the folded product information sheet 46 and the overlaminate 50 to the base label 48 may be carried out by feeding the plastic material of the base label 48 on a carrier strip 74 and feeding the overlaminate 50 from a roll. Initially, the base label 48, the overlaminate 50 and the carrier strip 74 may define continuous strips, with the product information sheets 46 at spaced locations along these continuous strips and between the overlaminate 50 and the base label 48. Die cutting then is employed to separate the continuous strips of the overlaminate 50 and base label 48 into separate patches 45 by cutting through both the overlaminate 50 and the base label 48 at locations centrally between adjacent product information sheets 46. The die cutting apparatus also may be employed to incorporate the perforation arrays into the overlaminate 50 at locations adjacent the folded edges of the top panel of the product information sheet 46. However, the die cutting does not sever the carrier strip 74 between the adjacent patches 45. Thus, a large number of the patches can be stored, transported and fed from the carrier strip 74.

Figure 12:
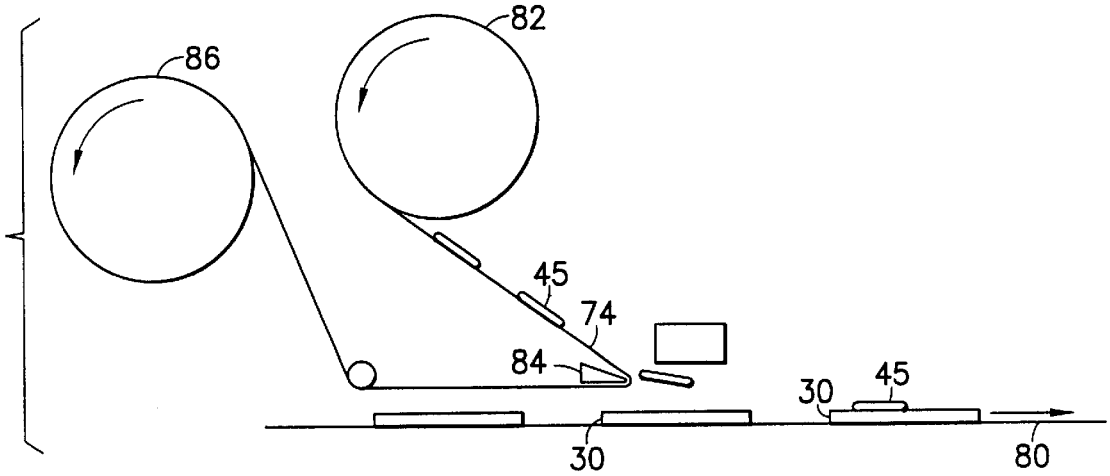
FIG. 12 is a schematic view of an apparatus for applying the product information patches to the brochure.

The product information patches 45 then are secured to the outer faces 44 of the rear panels 34 of the respective primary brochures 30. More particularly, the face of the base label 48 opposite the folded product information sheet 46 is adhesively secured to the selected location on the primary brochure 30. In a preferred method, as shown schematically in FIG. 12, the primary brochures 30 are fed at a high rate along a conveyor system 80 such that the outer faces 44 of the rear panels 34 face upwardly. Simultaneously, the carrier strip 74 delivers the product information patches 45 form a feed roll 82 toward the primary brochures 30 on the convey or 80. At an appropriate location, the carrier strip is bent almost 180° around a guide 84 and is redirected toward a take-up roll 86. The patches 45, however, continue along the initial direction of travel such that the face of the base label 48 opposite the folded product information sheet 46 is adhesively secured to the selected location on the primary brochure 30. The pressure for applying the product information patches 45 to the primary brochure 30 may be achieved with air pressure from an air flow generator 86 to avoid any direct pressure that could damage either the thin overlaminate 50 or the finally printed surfaces of the primary brochure 30. The brochure assembly 28 then can be packaged and shipped as appropriate.

The product information sheet can be accessed easily by pulling the folded product information sheet 46 and the overlaminate 50 away from the outer face 44 of the rear panel 34. This pulling force on the product information sheet 46 and the overlaminate 50 causes a tearing of the overlaminate 50 along one or both arrays of perforations 66 and 68. The base label 48 and regions of the overlaminate 50 between the top and bottom edges 62 and 64 and the respective perforation arrays 66 and 68 remain on the primary brochure 30. These remaining portions of the product information patch 45 provide little or no adhesive residue that would affect continued use and storage of the primary brochure 30. Additionally, the transparency of the base label 40 and overlaminate 50 or printing on the outer face of the base label 48 will not adversely affect the aesthetic appearance of the primary brochure 30 after removal of the product information sheet 46 and central portions of the overlaminate 50. In particular, the central portion of the outer face of the base label 48 is directly exposed, and the base label wings 56 and 58 are merely covered by the transparent plastic of the overlaminate 50.

The central portion of the overlaminate 50 remains affixed to the top panel of the folded product information sheet 46 after removal of the product information sheet from the primary brochure 30. As noted above, the overlaminate 50 is transparent, and hence has no adverse aesthetic or practical impact on the product information sheet 46. As explained above, the product information sheet 46 preferably is folded such that two parallel fold lines or closed ends exist on the outer panel and are aligned parallel to the top and bottom edges 62 and 64 of the overlaminate 50. As a result, any portions of the adhesive surface of the overlaminate 50 that exists between the folded product information sheet 46 and the respective perforation arrays 66 and 68 will not impede the opening or refolding of the product information sheet. Rather, the small areas of adhesive between the front panel of the folded product information sheet 46 and the respective perforation arrays 66 and 68 will merely adhere to portions of the product information sheet adjacent these fold lines.

Figure 10:
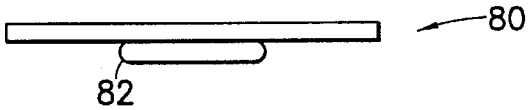
FIG. 10 is a cross-sectional view similar to FIG. 8 but showing a simpler brochure having only a single sheet and no folds.
Figure 11:
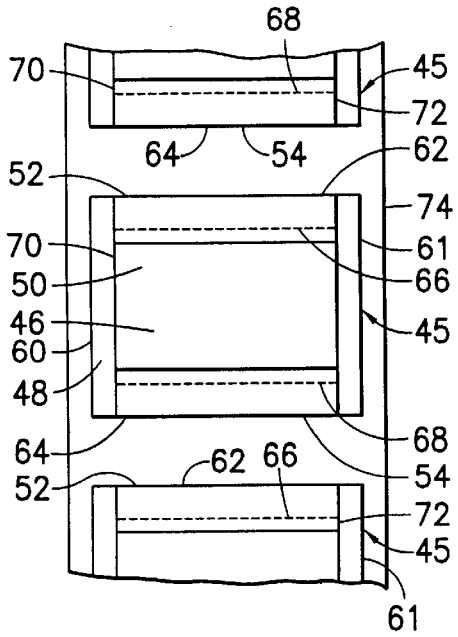
FIG. 11 is a top plan view of a carrier strip carrying a plurality of the product information patches.

A simplified version of the brochure is illustrated in FIG. 10 and is identified generally by the numeral 80. The brochure 80 includes only a single sheet with no folds. The product information patch 45 is adhered to one face of the brochure 80 substantially in the manner described above and can be removably separated and accessed as described above.

Figure 2:
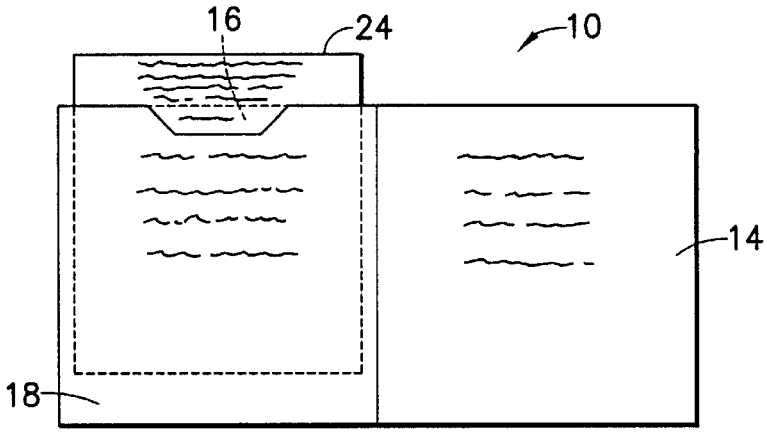
FIG.2 PRIOR ART
FIG. 2 is a top plan view of the assembled brochure in an open condition and receiving the product information sheet into the pocket formed in the brochure.
Figure 3:
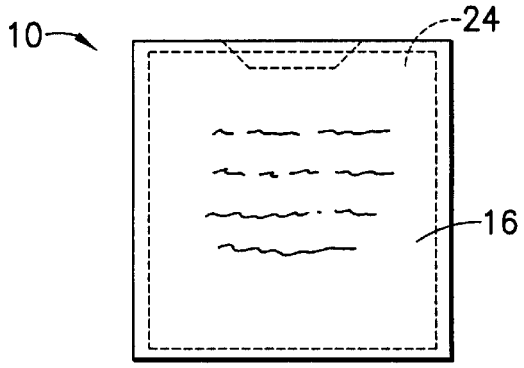
FIG.3 PRIOR ART
FIG. 3 is a top plan view of the prior art brochure in its fully folded condition.
Figure 4:
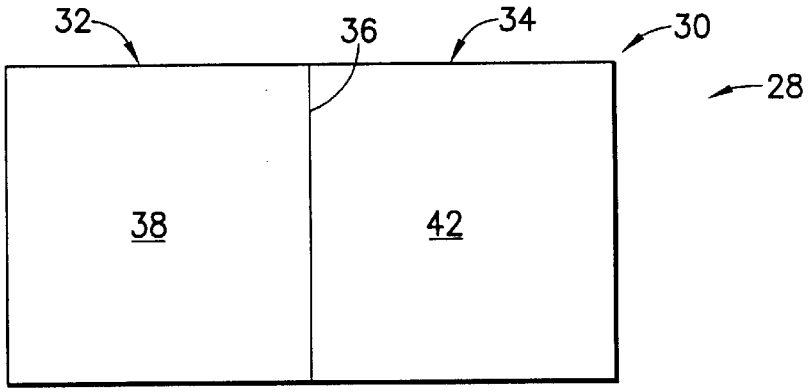
FIG. 4 is a plan view of a brochure in accordance with the subject invention showing the inside faces of the pages of the brochure when the brochure is in a fully opened condition.
Figure 5:
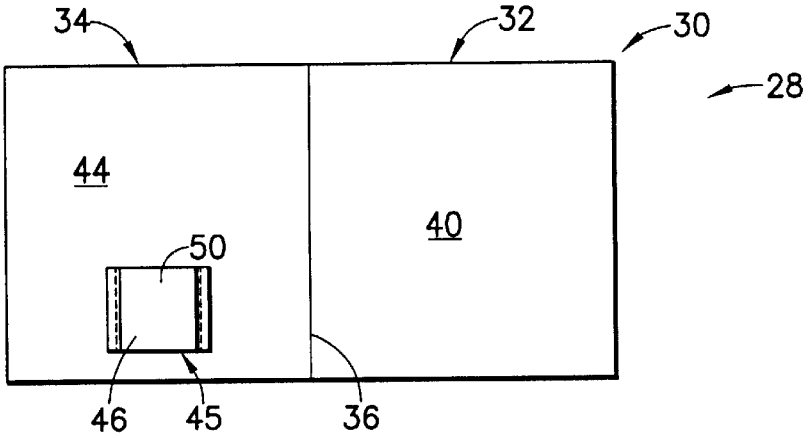
FIG. 5 is a plan view of the brochure shown in FIG. 4 showing the outside faces of the brochure when the brochure is in the fully opened condition.
Figure 6:
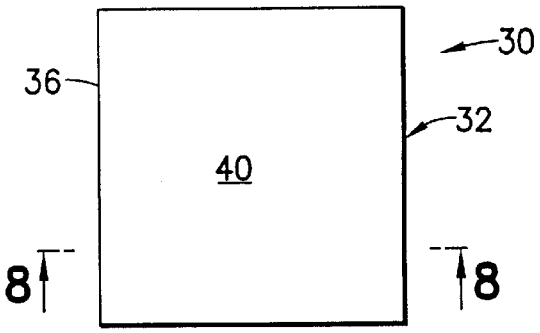
FIG. 6 is a top plan view of the brochure in the folded condition.
Figure 7:
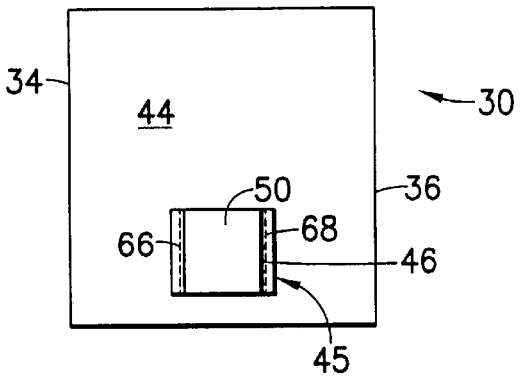
FIG. 7 is a bottom plan view of the brochure in the folded condition.
Figure 8:
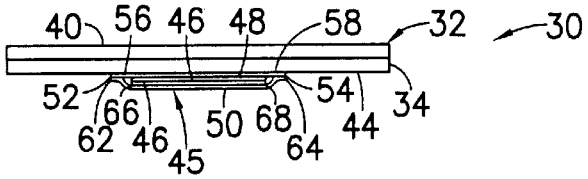
FIG. 8 is a cross-sectional view taken along line 8—8 in FIG. 6.
Figure 9:
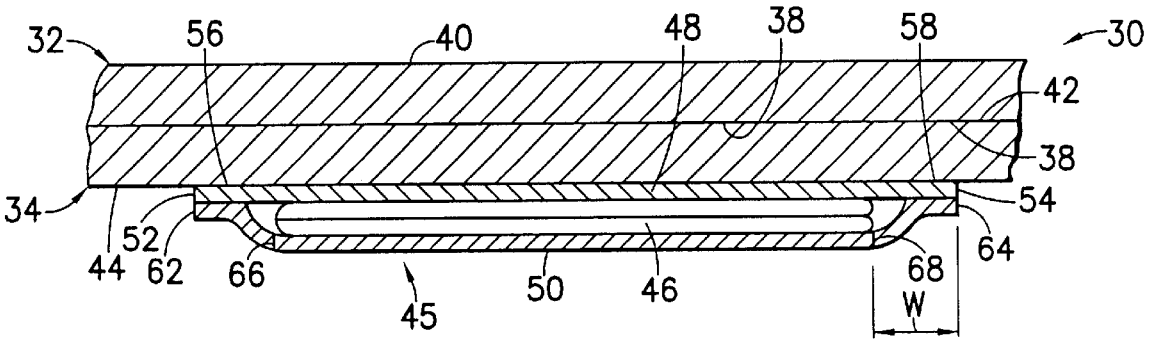
FIG. 9 is an enlarged view of a portion of the brochure shown in FIG. 8 including the product information sheet thereof.

The invention described and illustrated above provides several significant advantages over the prior art. In particular, a substantial savings in raw materials is achieved by not having to provide a inside panel as illustrated schematically in FIGS. 1–3 above in the description of the prior art. Additionally, the complex and costly process of adhering glue flaps of the inside panel to the front panel is avoided and the labor costs associated with manual insertion of the product information sheet into the formed pocket similarly are avoided. In contrast to the prior art, the invention described and illustrated above can have a substantial reduction in the paper or paper board material from which the brochure is made. Additionally, gluing of panels of the brochure can be avoided entirely and manual insertion can be illuminated.

While the invention has been described with respect to certain preferred embodiments, it is apparent that various changes can be made without departing from the scope of the invention as defined by the appended claims. For example, the product information sheet can be disposed at locations on the brochure other than the specific location illustrated in the figures. For example, the product information sheet may be at an interior location on the brochure.

What is claimed is:

1. A brochure assembly comprising a primary brochure formed from a unitary sheet of material printed with selected indicia thereon, and a product information patch removably attached to the primary brochure at a selected location thereon, the product information patch comprising a base label having a first surface adhered securely to the primary brochure and a second surface facing away from the primary brochure, the base label having parallel top and bottom edges, a product information sheet positioned on the base label inwardly from the respective top and bottom edges of the base label and an overlaminate disposed over the product information sheet and secured to at least portions of the base label between the parallel top and bottom edges of the base label and the product information sheet, the overlaminate including at least one weakened region between the product information sheet and at least one of said top and bottom edges of the base label, whereby the overlaminate can be severed along the weakened region for separating the product information sheet from both the base label and the primary brochure.

2. The brochure assembly of claim 1, wherein the sheet of material forming the primary brochure includes first and second panels hingedly articulated to one another along a fold line to define a front panel and a rear panel, the front and rear panels each having an outer face and an inner face, the product information patch being removably adhered to a selected location on the outer face of the rear panel.

3. The brochure assembly of claim 2, wherein the product information sheet is folded to define a size substantially smaller than the rear panel of the brochure.

4. The brochure assembly of claim 1, wherein the overlaminate is secured to the product information sheet.

5. The brochure assembly of claim 1, wherein the top and bottom edges of the base label are spaced from the product information sheet by at least 0.25".

6. The brochure assembly of claim 1, wherein the product information sheet is folded to define a plurality of panels, one said panel defining an outer panel facing outwardly from the primary brochure, the outer panel comprising two parallel fold lines disposed substantially parallel to the top and bottom edges of the base label.

7. The brochure assembly of claim 6, wherein the at least one weakened region comprises a pair of weakened regions extending parallel to the respective top and bottom edges of the base label and disposed between the product information sheet and the respective top and bottom edges of the base label.

8. The brochure assembly of claim 7, wherein the weakened regions comprise arrays of perforations.

9. The brochure assembly of claim 1, wherein the overlaminate is formed from a transparent plastic material.

10. The brochure assembly of claim 1, wherein the base label comprises a sheet of coated paper, the first surface of the base label having a layer of adhesive thereon for secure attachment to the primary brochure, the second surface of the base label being printed.

11. The brochure assembly of claim 1, wherein the product information sheet is formed from an ultra thin paper having a weight not more than 40.

12. The brochure assembly of claim 1, wherein the overlaminate includes top and bottom edges registered respectively with the top and bottom edges of the base label.

* * * * *